US006604818B2

(12) United States Patent
Leibman et al.

(10) Patent No.: US 6,604,818 B2
(45) Date of Patent: Aug. 12, 2003

(54) CONTROLLED WATER EVAPORATION FROM INK JET INKS

(75) Inventors: Bernard Leibman, Webster, NY (US); Steven J. Dietl, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/040,814

(22) Filed: Jan. 7, 2002

(65) Prior Publication Data

US 2003/0128259 A1 Jul. 10, 2003

(51) Int. Cl.[7] ..... B41J 2/175
(52) U.S. Cl. ..... 347/86
(58) Field of Search ..... 347/84, 85, 86, 347/87, 100

(56) References Cited

U.S. PATENT DOCUMENTS 5,793,390 A * 8/1998 Claflin et al. ..... 347/33
6,158,853 A * 12/2000 Olsen et al. ..... 347/86

* cited by examiner

*Primary Examiner*—Anh T. N. Vo
(74) *Attorney, Agent, or Firm*—Perman & Green, LLP

(57) ABSTRACT

An ink jet printing apparatus and method for ink jet printing is described. The apparatus includes an ink reservoir for containing a water based ink and a moisture barrier positioned between the ink in the ink reservoir and ambient air. The moisture barrier is formed of microencapsulated water beads adapted to provide a sustained release of the water into ambient air.

10 Claims, 1 Drawing Sheet

CONTROLLED WATER EVAPORATION FROM INK JET INKS

BACKGROUND OF THE INVENTION

1. Field of the Invention

Figure 1:
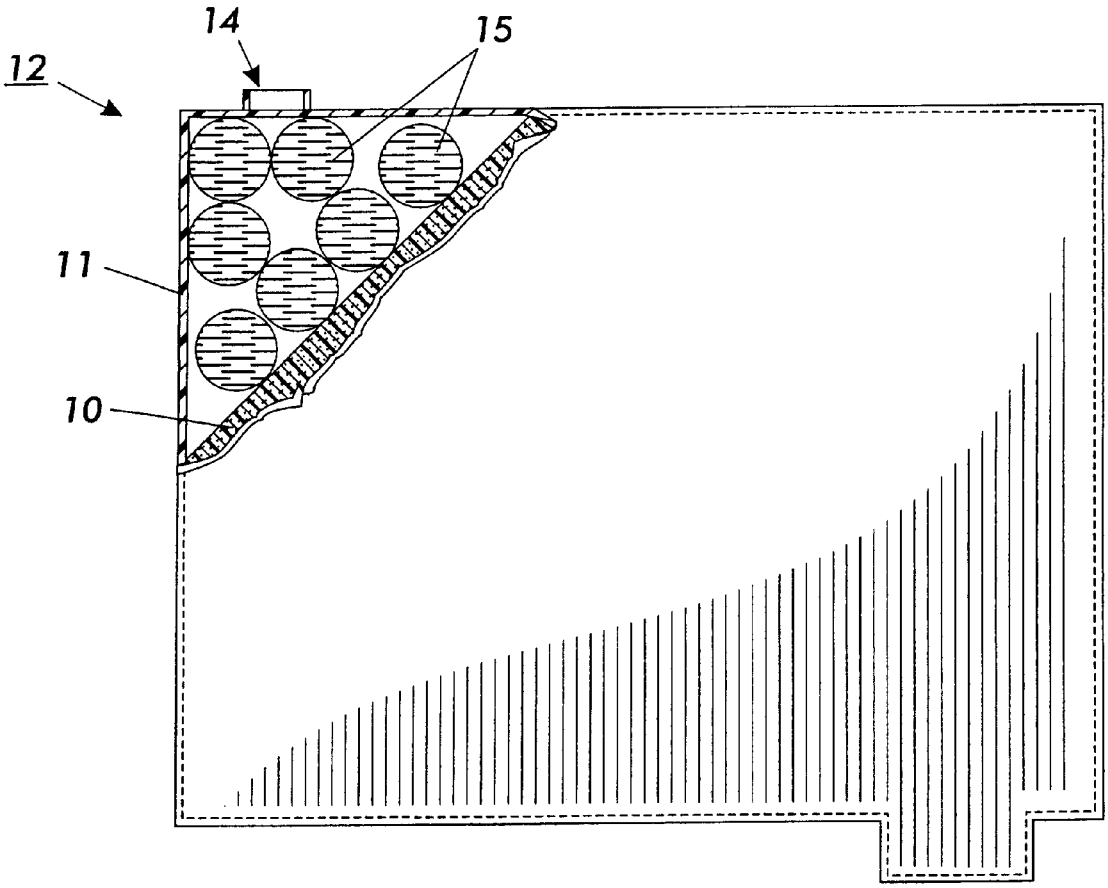

The present invention relates to ink jet recording devices such as printers, copiers, facsimile machines, word processors and plotters, and more particularly to an ink jet printing apparatus having means in the form of a moisture barrier for decreasing water evaporation from the ink.

2. Description of the Prior Art

The basic principle of an ink jet recording system is to eject a liquid or fused solid ink from a nozzle, slit, porous film or the like to make a recording on a recording material such as paper, cloth or film. For ejecting an ink, various methods have been proposed, such as a method of ejecting an ink using an electrostatic induction; namely, the so-called charge control system; a method of ejecting an ink using a piezoelectric element and an oscillation pressure; and a method of ejecting an ink using a pressure generated as a result of forming and growing bubbles by heat, the so-called thermal ink jet system. By using any of these methods, a high precision image on a recording material can be obtained.

Ink jet printing systems generally are of two types, i.e. continuous stream and drop-on-demand. In continuous stream ink jet systems, ink is emitted in a continuous stream under pressure through at least one orifice or nozzle. The stream is disturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or to a specific location on a recording medium. In drop-on-demand systems, a droplet is expelled from an orifice directly to a position on a recording medium in accordance with information from digital data signals. A droplet is not formed or expelled unless it is to be placed on the recording medium.

Since drop-on-demand systems require no ink recovery, charging, or deflection, the system is much simpler than the continuous stream type. There are two types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. The droplet ejection system based upon thermally generated bubbles is commonly referred to as the "bubble jet" system.

In all of the various ink jet printing systems described above, the ink jet printing apparatus employs a reservoir for containing the ink. Since the inks generally used are water based (aqueous) inks, one potential issue is the fact that water is lost from the ink over time due to evaporation. Water loss can create basic disadvantages in the printing process in that the water that is lost from the ink over time causes changes in the ink properties and therefore effects printing performance characteristics. Current ink jet systems resolve the water loss problem by creating long vent paths or by using moisture barrier materials. However, these solutions are basically not the most efficient way to avoid the water loss related issues.

SUMMARY OF THE INVENTION

The above described disadvantages in a water based ink jet system are overcome by an ink jet apparatus that includes an ink reservoir for containing inks and a moisture barrier positioned between the ink in the ink reservoir and ambient air, the moisture barrier formed of microencapsulated water beads which preferentially releases water to the ambient air due to their relative proximity to the ventilation path. In this way, the water loss rate from the ink is reduced.

An ink jet printing process is also described which comprises the steps of incorporating an aqueous based ink composition into an ink jet printing apparatus that includes a reservoir for containing ink and a moisture barrier positioned between the ink in the ink reservoir and ambient air, the moisture barrier formed of microencapsulated water beads in proximity to the ventilation passage to provide a sustained release of the water to the ambient environment. Thereafter, droplets of the ink are caused to be ejected in an imagewise pattern onto a recording sheet.

DETAILED DESCRIPTION OF THE DRAWINGS

The accompanying drawing, which is incorporated in and constitute a part of the specification illustrate specific embodiments of the invention and, together with the description hereinbelow serve to explain the principles of the invention.

FIG. 1 is a partial plan view of an ink jet ink storage tank illustrating the features of the invention.

While the present invention will be described hereinafter in connection with a preferred embodiment thereof, it should be understood that it is not intended to limit the invention to that embodiment. On the contrary, it is intended to cover all alternative, modifications and equivalents as may be included within the spirit and scope of the invention as defined by the appended claims.

DESCRIPTION OF THE PREFERRED EMBODIMENTS

Inks typically used in ink jet recording devices are primarily water based and comprise water, a solvent, colorants, and additives. In fact, generally speaking an ink jet ink is required to possess the following characteristics:

(1) Inks should produce a uniform image having high resolution and high density, and also images free from any blur or fog once on paper.

(2) Inks should bring about no clogging at the tip of an ink jet nozzle caused by dried ink, and also always have a high level of jetting responsibility and stability.

(3) Inks should provide excellent drying characteristics on paper.

(4) Inks should provide an image having good fastness.

(5) Inks should provide high long-term storage stability.

Any one or more of the above desired characteristics for ink jet inks can be interfered with by a naturally occurring event such as the evaporation of water from the ink. In fact, the concept that water evaporation can be a significant issue with regard to ink jet inks can be easily understood once one realized the large amount of water that is generally present in these inks.

The water used in a water based ink for ink jet recording is preferably ion exchanged water, ultrapure water, distilled water or ultrafiltered water, so that mixing of impurities can be prevented. The water is preferably contained in an amount of from 25 to 95 wt % based on the entire weight of the ink for ink jet recording. If the water content is less than 25 wt %, the ejection related properties are generally deteriorated, whereas if the water content exceeds 95 wt %, disadvantages such as clogging of the nozzle tend to occur.

Inks exhibit various sensitivities with regard to water loss. This effects an ink's functional window as far as the shelf and operational life of an ink jet cartridge containing the ink, is concerned. If enough water evaporates from the ink solution, the ink will generally no longer perform efficiently and will not meet print process requirements thereby resulting in a complete malfunction of the ink jet system.

Features of the present invention as illustrated in FIG. 1 to control water evaporation from ink jet inks propose adding a moisture barrier 11 between the ink reservoir 10 and ambient air 12 to prevent or slow down water evaporation through the ink tank vent hole 14. The moisture barrier would be made up of micro encapsulated water beads 15, i.e. water in a capsule that would evaporate over time thus humidifying the air inside the tank. The resulting highly humid air would release water molecules to the ambient air through the ventilation path if the ambient environment is less humid then the air in reservoir 10. The evaporation of water from the ink is therefore decreased due to the presence of highly saturated adjacent air. The sustained release of water from the water beads can be in a timed relation to the evaporation of water from the ink so that there is an equilibrium established as far as the water content of the ink is concerned. This would guarantee that there was always a water content in the ink present for the life of the ink cartridge. An example of the kind of microencapsulated water beads that can be used with the present invention are water microspheres manufactured by the Brace Co.

Ink reservoirs 10 that can be used with the present invention can just about be any ink reservoir, (i.e. a tank) such as an individually replaceable ink tank or a larger reservoir such as a FWA or bulk storage tank. The microspheres can be designed to time release water in a timed relation to the normal evaporation rate from an ink supply vent. One embodiment of the present invention would have the microspheres in communication with the ink so that the water microspheres would humidify the vent path.

While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An ink jet printing apparatus for ejecting an aqueous ink from a reservoir through a nozzle to form high precision images on a recording material, said apparatus comprising an ink reservoir for containing an aqueous ink, an airspace for receiving water evaporated from said aqueous ink to form a humid atmosphere within said airspace, and a ventilation port in said reservoir open to ambient air outside the reservoir to permit the release of water from the humid atmosphere within the reservoir airspace to the ambient air outside the reservoir whenever the humidity of the ambient air is lower than the humidity of the airspace within the reservoir, and a moisture barrier positioned between the ink in the ink reservoir and the ventilation port, the moisture barrier being formed of microencapsulated water beads adapted to provide a sustained release of the water to ambient air through said ventilation port, in order to maintain the water content of the ink at an equilibrium.

2. An ink jet apparatus according to claim 1 wherein said microencapsulated water beads are microspheres containing water.

3. An ink jet apparatus according to claim 1 wherein said water is released from said microspheres timed to the rate that said water evaporates from said ink.

4. An ink jet apparatus according to claim 1 wherein said microspheres lie in contiguous relation to said ink whereby said microspheres provide humidity to the ventilation port and isolate said ink from any lower humidity in the ambient air.

5. An ink jet printing process for ejecting an aqueous ink from a reservoir through a nozzle to form high precision images on a recording sheet, said process employing an apparatus having an ink reservoir containing a water based ink and a ventilation port positioned between an airspace over the ink in the reservoir and ambient air, characterized by a step of interposing a moisture barrier layer formed of microencapsulated water beads, adapted to provide a sustained release of water from said airspace to the ambient air through said ventilation port whenever the humidity of the ambient air is lower than the humidity of the airspace within the reservoir, in order to maintain the water content of the ink at an equilibrium.

6. A process according to claim 5 wherein the recording sheet is plain paper.

7. A process according to claim 5 wherein the recording sheet is a transparency.

8. A process according to claim 5 wherein the recording sheet is a photopaper.

9. An ink jet process according to claim 5 wherein said water is released from said microspheres timed to the rate that water evaporates from said ink into said airspace.

10. An ink jet process according to claim 5 wherein said microspheres are interposed in contiguous relation to said ink whereby said microspheres provide humidity through the ventilation port to the ambient air and isolate said ink from any lower humidity in the ambient air to maintain the water content of the ink at an equilibrium.

* * * * *